United States Patent [19]

Goof

[11] 4,374,374

[45] Feb. 15, 1983

[54] ELECTRIC CONTACT DEVICE

[76] Inventor: Sven K. L. Goof, 236A Gl. Strandvej, DK-3050 Humlebaek, Denmark

[21] Appl. No.: 254,214

[22] Filed: Apr. 15, 1981

[30] Foreign Application Priority Data

Apr. 17, 1980 [DK] Denmark ..... 1635/80

[51] Int. Cl.[3] ..... H01C 10/10

[52] U.S. Cl. ..... 338/114; 338/252; 338/302

[58] Field of Search ..... 338/69, 99, 114, 252, 338/302, 270, 303, 267, 268; 200/85 R, 86 R, 86.5, 159 B, 333

[56] References Cited

U.S. PATENT DOCUMENTS

| | | | |
|---|---|---|---|
| 2,132,685 | 10/1938 | Hampton et al. | 200/86 |
| 2,437,969 | 3/1948 | Paul | 200/86 R |
| 3,783,689 | 1/1974 | Ehrenfried et al. | 200/85 R X |
| 3,794,790 | 2/1974 | Leyland | 338/114 X |
| 3,960,044 | 6/1976 | Nagai et al. | 338/114 X |
| 4,208,648 | 6/1980 | Naumann | 338/114 X |

FOREIGN PATENT DOCUMENTS

| | | |
|---|---|---|
| 122199 | 6/1972 | Denmark . |
| 1017252 | 10/1957 | Fed. Rep. of Germany . |
| 1162913 | 2/1964 | Fed. Rep. of Germany . |
| 2101193 | 8/1972 | Fed. Rep. of Germany . |
| 978690 | 11/1950 | France . |
| 272893 | 8/1928 | United Kingdom . |
| 1272165 | 4/1972 | United Kingdom . |
| 1501416 | 2/1978 | United Kingdom . |
| 1534683 | 12/1978 | United Kingdom . |
| 1544448 | 4/1979 | United Kingdom . |
| 2030773 | 10/1980 | United Kingdom . |

*Primary Examiner*—C. L. Albritton
*Attorney, Agent, or Firm*—Fleit & Jacobson

[57] ABSTRACT

An electric contact or circuit breaker device comprises a base member and an operating member. In a surface of the base member, there is provided at least one elongated indentation wherein an electric conductor is inserted and is without electrical connection with the base member. The operating member includes a cover layer of a resilient material which extends over each indentation in the base member. The cover layer is electrically conducting in order to establish electric connection between the cover layer and the conductor, when a pressure is applied to the cover layer in a direction towards or into the indentation. When the pressure ceases, the resiliency of the cover layer will break the electric connection. The electric contact device thus provided can be sealed in a simple and effective manner against intrusion of dirt and damp and the parts of the device are subjected to minimum mechanical wear.

8 Claims, 6 Drawing Figures

FIG 1.
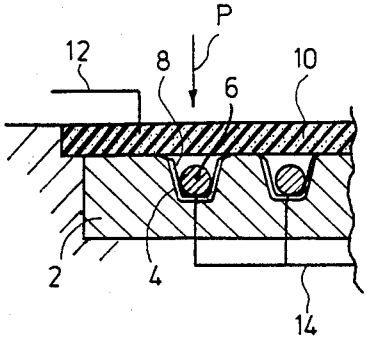
FIG 2.
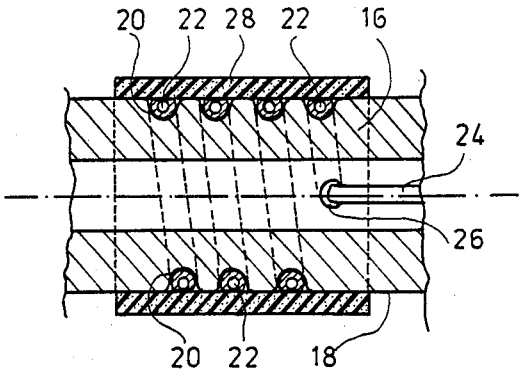
FIG 3.
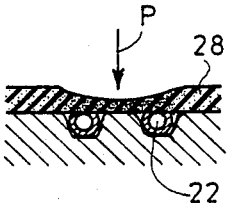
FIG 4.
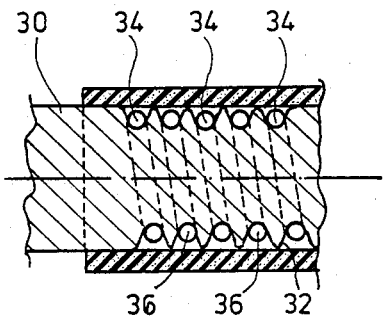
FIG 5.
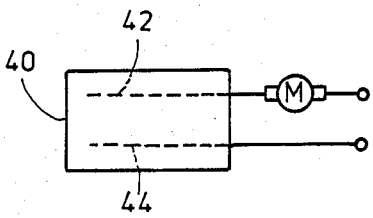
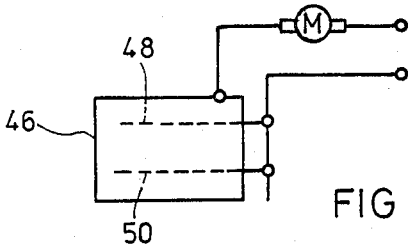
FIG 6.

ELECTRIC CONTACT DEVICE

The present invention relates to electric contact devices in general, and in particular to an electric contact device for operating and controlling electric units, and comprising a base member carrying at least one electric conductor extending along a surface of said base member and defining a first contact member of the device, and an electrically conducting cover layer which covers each conductor on said base member and defines a second contact member of the device, said first and second contact members being without electrical connection in the normal, passive state of the device.

Contact devices of this type have been suggested in which the two contact members are separated by electrically insulating members or by a coherent insulating partition provided with slots, openings or the like through which contact can be made between the contact members by applying an external pressure to the cover layer of the device. The partition or separating members are resiliently compressible or flattenable in order to permit or provide such contacts and also in order to return the contact members of the device to their completely separated state when the pressure has ceased.

Examples of the electric contact devices which include such resiliently compressible or flattenable and insulating partitions between the conductors or contact members are disclosed in German Pat. No. 2,101,193 and in British Pat. No. 272,893.

Such insulating and compressible partitions or contact separating members are complicating and cost increasing elements.

It is, accordingly, an object of this invention to provide an improved contact device of the type discussed above and which does not need or include compressible and insulating partitions or members for separating the contact members of the device. Moreover, the improved contact device should be capable of being sealed in a simple and effective manner against intrusion of dirt and moisture and should only include few parts which are subjected to mechanical wear.

In order to carry the above objectives into effect, the improved contact device of the invention is characterized by each electric conductor being recessed in a corresponding elongated indentation defined in the surface of the base member, and by the cover layer being resiliently deformable about confronting edges which define said indentation, so as to be depressed into said indentation to establish electrical connection with said conductor therein, thereby closing a current flow path through the device.

A preferred embodiment is characterized in that the base member surface is a cylindrical surface in which each elongated indentation is defined as a helical groove having a helically wound conductor inserted therein. This embodiment is particularly suited for mounting on or incorporation in a rod-shaped handtool or a handpiece, e.g. for a dental instrument. A motor associated with such a tool or instrument can thereby be controlled by means of the contact device of the invention which can be operated by a finger tip, while the tool or the handpiece is held and manipulated in one hand.

The cover layer of the contact device, which can appropriately be a tubular cover sleeve, can, moreover, be sealed to the outer surface of the tool or handpiece, in particular when the base member of the device is disposed in an appropriate circumferential recess in the surface of the tool or handpiece. Intrusion of moisture into the contact device and into the tool or handpiece can, thereby, be effectively prevented.

The invention also relates to a method of manufacturing the above preferred embodiment, the method comprising the steps of providing a base member of a generally rigid material and having a cylindrical surface area extending along at least a portion thereof, providing at least one helical groove in said cylindrical surface area, applying an electric conductor in each groove, and applying a tubular, electrically conducting and resiliently deformable sleeve over said cylindrical surface area, thereby covering each groove.

Further features of this invention will become apparent from the following detailed description taken in conjunction with the accompanying drawing, wherein FIG. 1 is a schematic illustration of the basic principal of the electric contact device of the invention, FIG. 2 is a schematic illustration of an embodiment including a tubular base member, FIG. 3 is a partial, schematic view illustrating a particular embodiment having a potentiometer-action, FIG. 4 is a schematic illustration of a preferred embodiment including two separate and helical conductors, and FIGS. 5 and 6 are respective schematic illustrations showing two main types of embodiments of the device according to the invention.

The schematic view of FIG. 1 shows the main component parts of an electric contact device in accordance with the invention. In a surface of a base member or base body 2, which is made of a relatively rigid material, there is provided at least one elongated indentation or groove 4 in which an electric conductor 6 is inserted. The conductor 6 is without electrical connection with the walls of the indentation or with the base member as indicated schematically by a coating 8. A cover layer 10 made of a resilient and electrically conducting material covers the indentations 4 of the base member and is preferably attached, e.g. by glueing.

By applying a more or less local pressure as indicated by an arrow P, the resilient cover layer 10 can be deformed towards or into the indentation 4 whereby electrical connection is provided between suitable connections or terminal wires as indicated at 12 and 14. When the pressure P ceases, the resiliency of the cover layer will have the effect of breaking the electrical connection again, because the cover layer returns to its schematically shown initial or starting position.

The base member 2 may be a plate in which the indentations 4 are provided as grooves which extend e.g. in parallel, appropriately distributed over one surface of the plate. Alternatively, the base member may be cylindrical or tubular with the indentations 4 provided as circumferential or annular grooves.

Each of the electric conductors 6 may be either insulated wires or bare wires having a shape and a cross-section adapted to the associated indentations or grooves 4. In some cases, one single conductor or wire may continue through several grooves. As an example, a single conductor 6 can be disposed in a zigzag shape through several grooves 4 in a base member 2 having a set of several parallel grooves 4.

When the base member 2 is made of an electrically insulating material, one or more bare conductors 6 can be inserted directly in the grooves 4, e.g. by glueing.

When the base member 2 is made of an electrically conducting material, bare conductors 6 can also be employed, if the conductors are inserted in an insulating layer which separates the conductor and the base member as indicated by the coating 8 in the indentation 4. Moreover, each conductor 6 can be an insulated wire, provided that the insulation is removed along the area of the wire which faces the cover layer 10, e.g. after the wire has been glued in the indentation 4.

One or both ends of each conductor 6 may be designed for electrical connections thereto. As an example, the ends of the connector may be connected to respective contact points or terminals such as plugs or contact sockets which in a simple manner are able to establish electrical connections as needed to the conductors 6, when mounting the base member 2, e.g. on a handtool. Moreover, one or both ends of each electric conductor 6 may be threaded through the base member 2 so that possible connection points may be present on the underside or inner side of the base member.

Generally, the cover layer 10 should be made of a material which is electrically conducting, at least when a pressure P is applied thereto. Moreover, the material should have resilient or elastic properties which are sufficient to return the material to its initial or passive state, when the pressure ceases.

Several electrically conducting rubber materials, which are suitable for this purpose, are known and some of these materials have an electrical conductivity which depends on the instant state of compression or compression ratio of the material. When the material has an electrical conductivity of some magnitude in its free and uneffected state, an effective circuit breaker action will necessitate that the contact device of the invention has a clearance between the underside or inner side of the cover layer 10, and the outer side or overside of the respective conductors 6. Such clearances may be provided by countersinking the conductors 6 in the indentations 4 as indicated in FIG. 1, or by inserting suitable rigid spacers (not shown) between the cover layer 10 and the base member 2. However, there are materials available of the type in question which have a substantially negligible conductivity in the free or non-compressed state of the material. With such materials, a clearance as just mentioned is not absolutely necessary in the device of the invention.

If necessary, the resilient returning of the cover layer material to its initial state may be provided or supported by incorporated or adding separate elastic means. As an example, the cover layer 10 may be a laminate including an inner layer of electrically conducting material and an outer layer of an elastic material which, moreover, may be electrically insulating.

With the basic principles described above and with certain variations thereof, there is provided a very effective contact or circuit breaker device which includes very few and simple component parts which are subjected to a minimum of mechanical wear. With a sufficient seal between the cover layer 10 and the base member 2, in particular along the edges or margins of the cover layer, it is also possible to achieve a complete sealing against intrusion of dirt and dampness.

When, and as long as a sufficient pressure P is applied to the cover layer 10, e.g. by means of a finger tip, the contact device of the invention is closed or switched on. The electrical connection thus provided will be broken again, when the pressure ceases.

The base member 2 may be adapted to and attached to a support as the actual need may be, and moreover, the base member can be incorporated directly in a support, e.g. in an apparatus housing. As indicated in the left part of FIG. 1, the base member 2 and possibly also the cover layer 10, can be countersunk into the support to such an extent that the cover layer is flush with the adjacent surface of the support.

Whether or not the cover layer 10 is countersunk into the support, it may be appropriate that at least one edge or margin of the cover layer extends beyond the corresponding edge of the base member 2 as indicated in the left part of FIG. 1. Thereby, the cover layer 10 can be electrically connected with the support which frequently serves as ground conductor in an apparatus. Thereby, a separate connection wire such as the wire 12, will be unnecessary and, moreover, the entire base member 2 may be made of an electrically insulating material and, accordingly, the conductors 6 can be bare wires inserted directly in the indentations 4.

FIG. 2 of the drawing illustrates an embodiment having an electrically conducting base member 16 which has a cylindrical surface area 18, wherein an indentation corresponding to the indentation 4 in FIG. 1 is provided as a helical groove 20 with a helical electric conductor 22 inserted therein. The conductor 22 may be mounted as mentioned in connection with FIG. 1, but in the embodiment shown, the conductor is an insulated wire which is glued in its associated groove 20. Thereafter, the insulation of the wire has been removed on the exterior side, e.g. by a cutting or turning operation, until the central conductor is exposed. If necessary, this turning operation may be performed or adapted so that the exposed conductor surface will be countersunk relative to the cylindrical surface area 18 of the base member, whereby a clearance can be provided between the conductor and the cover layer as mentioned above in connection with FIG. 1.

The helical conductor 22 may communicate with a connection wire corresponding to the wire 14 indicated schematically in FIG. 1. However, in accordance with the invention, one end 24 of the helical conductor 22 is preferably threaded into the interior of the base member 16 in order to establish electrical connection with an electric unit, in particular an electrical motor (not shown). As indicated in FIG. 2, the end 24 of the insulated wire 22 may merely extend through an aperture 26 which is provided at a suitable location in the bottom of the helical groove 20.

In embodiments as that of FIG. 2, the cover layer may be designed as mentioned in connection FIG. 1. However, in accordance with the invention, the cover layer is preferably a tubular sleeve 28, of an electically conducting and resiliently compressible material of the type which has an electrical resistance or conductivity which changes with the degree of compression of the material.

In addition to a circuit breaker action, the device of the invention can thereby provide a potentiometer-action which may be used to control an electric unit which is connected to the conductor end 24.

FIG. 3 shows how the cover layer material 28 has been locally compressed by applying a pressure P which acts over an area and may be applied by a finger tip. With a material of the above type, there will be established an electrical connection between the two parts of the conductor 22 and the intermediate area of the electrically conducting base member 16. The conductivity of this connection will increase with increasing compression of the material 28. By pressing a finger tip more or less firmly against the cover layer material 28, a potentiometer-action will, accordingly, be provided and may be used e.g. to control or adjust the rotational speed of an electric motor.

FIG. 4 shows schematically a preferred embodiment wherein two separate helical and bare conductors 34, 36 are disposed in respective thread-like grooves 32 in a cylindrical or tubular base member 30. The grooves 32 are simple to provide by use of thread cutting techniques, and the conductors 34, 36 are bare conductors which, as indicated, preferably are disposed in the grooves with a clearance to the electrically conducting cover layer which preferably is a tubular sleeve corresponding to the sleeve 28 of the embodiment in FIG. 2.

As indicated in FIG. 4, the two helical conductors are disposed in such a manner that the turns of one conductor 34 are disposed between the turns of the other conductor 36. Each of the conductors may appropriately be made as a coil spring of spring wire material and with dimensions which are adapted to the associated screw thread grooves 32 so that the conductors are able to remain in position in the grooves without using specific attachment means such as glue.

With a solid base member 30, one end (e.g. the left end in FIG. 4) of each helical conductor may extend out from the respective screw grooves 32 in a suitable, not shown manner. As mentioned in connection with FIG. 1, these conductor ends may be connected to or provided with contact points or terminals such as axially extending plugs or sockets, arranged e.g. at diametrically opposite points of the base member 30.

A corresponding arrangement can, of course, also be used in connection with a tubular base member 30, but in that case the conductor ends may also extend into the interior of the base member similar to the conductor end 24 in FIG. 2.

By applying a local exterior pressure at any point on the cover sleeve, the sleeve is, accordingly, able to establish and break electrical connection between the two helical conductors 34 and 36 provided that the turns of the conductors are disposed sufficiently close to each other so that a pressure applied by means of a finger tip has a working area which is sufficient to cover two adjacent conductor turns, one thereof belonging to the conductor 34, while the other belongs to the conductor 36.

By using a cover layer material having a conductivity which increases with the compression of the material, it is also possible to provide a potentiometer-action in a similar manner as mentioned in connection with FIG. 3.

Generally speaking, the embodiments of the contact device according to this invention can be divided into two main types. A first main type, to which the embodiment of FIG. 4 belongs, can serve to control or operate e.g. an electric motor M as shown schematically in FIG. 5. At least two concurrent conductors 42, 44, which correspond to the helical conductors 34, 36 in FIG. 4, are covered by the resiliently and electrically conducting cover layer 40 which may be shaped as a plate or as a sleeve. A pressure applied to the cover layer 40 is, accordingly, able to establish and break electrical connections between the conductors 42 and 44 whereby the motor M can be started and stopped and, possibly, also can be controlled as far as rotational speed is concerned. In addition to the helical shapes as in FIG. 4, the conductors 42 and 44 may also have other shapes such as concurrent zigzag shapes. Moreover, each of the two conductors may include a set of single conductors which are arranged with the single conductors belonging to one set, disposed alternating with or interposed between concurrent single conductors belonging to the other set.

The other main type to which the embodiment of FIG. 2 belongs is illustrated schematically in FIG. 6. At least one conductor 48 or 50 corresponding to the helical conductor 22 in FIG. 2 is covered by the cover layer 46. By applying a local pressure at the area over the conductor 48 or 50, an electrical connection between the conductor and the cover layer (or the base member, if made of a conducting material) can be established. An electric motor M may thereby be controlled as described in connection with FIGS. 1, 2 and 3.

A potentiometer-action similar to that mentioned in connection with FIG. 3 may also be provided in connection with a plate shaped base member. However, the potentiometer-action is particularly suitable in connection with embodiments as those of FIGS. 2 and 4, because such embodiments are particularly suited for use in connnection with small electrically powered hand-tools such as dental instruments which are held and manipulated as a pencil in one hand during the use. The base member may be incorporated in the instrument or in parts thereof and the tubular cover layer sleeve which may be appropriately recessed into the surface of the instrument as indicated in FIG. 1, can be operated by a finger tip, regardless of the instant angular position of the instrument about a longitudinal axis thereof. This is a substantial advantage in particular in connection with dental instruments.

While the device of the invention is primarily intended for direct action on the cover layer by means of a finger tip in order to apply the pressure P, there is nothing to prevent that the device of the invention is provided with mechanical operating means.

In summary, the invention is based on the fact that an electrically conducting and resiliently deformable cover layer is supported on two relatively rigid and non-yielding edges which define a groove therebetween in a base member. In the groove, there is a conductor which has a bare surface at least on the side facing towards the cover layer. By pressing on the cover layer, a portion thereof can be resiliently deformed about the two edges and thereby be depressed into the grooves so that contact and electrical connection is established between the conductor and the cover layer as long as the pressure is maintained.

The current path thus provided through the device can extend either between two separated conductors via the conducting cover layer (FIG. 5), or from the base member and to a conductor via the cover layer, or from an apparatus housing and to a conductor via the cover layer (FIG. 1 or 6).

Features described above in connection with the embodiments represented in the drawing may be varied and otherwise combined and it is to be appreciated that the invention should not be limited to the specific examples given.

I claim:

1. An electric contact device for operating and controlling electric units, such as an electric motor, said device comprising a base member, at least one electric conductor carried by and extending along a surface of said base member and defining a first contact member of the device, and an electrically conducting, resiliently deformable cover layer covering said conductor and defining a second contact member of the device, said first and second contact members being without electrical connection in a normal, passive state of the device, said electric conductor being recessed in a corresponding elongated indentation defined in said surface of the base member, said base member being relatively rigid in comparison with said cover layer so that said cover layer is resiliently deformable about confronting edges of said base member defining said indentation without deformation of said confronting edges, so as to be depressed into said indentation to establish electrical connection with said conductor therein, thereby closing a current flow path through the device.

2. The device of claim 1, characterized in that the base member surface is a cylindrical surface in which said elongated indentation is defined as a helical groove having a helically wound conductor inserted therein.

3. The device of claim 2 characterized in that at least one end of said helically wound conductor extends into the interior of the base member for establishing electrical connection with an electric unit, in particular an electric motor.

4. The device of claim 2 or 3, characterized in that said cover layer is a tubular sleeve made of a compressible, resilient material of the type having an electrical conductivity that varies with the compression ratio of the material.

5. A method of manufacturing an electric contact device for operating and controlling electric units such as an electric motor, characterized by comprising the steps of:

providing a base member of a generally rigid material and having a cylindrical surface area extending along at least a portion thereof, providing at least one helical groove in said cylindrical surface area, applying an electric conductor in each groove, and applying a tubular, electrically conducting and resiliently deformable sleeve over said cylindrical surface area, thereby covering said groove, the resiliency of said sleeve being such that said sleeve is moved into a conducting condition by application of force to said sleeve and is moved from the conducting condition to a nonconducting condition by the resiliency of said sleeve, the rigidity of the base member being such that said sleeve is movable into the conducting condition thereof without deformation of said base member.

6. The method of claim 5, characterized in that an insulated wire is used as said conductor, and in that the central conductor of said wire is exposed to the exterior by removing insulating material from said helically wound wire.

7. An electric contact device for operating and controlling an electric unit comprising:

a base member having an outer surface and an indentation formed in the outer surface;

a conductor disposed in said indentation; and an electrically conducting, resiliently deformable cover layer in contact with the outer surface of said base member and covering said conductor in said indentation, said cover layer being resiliently deformable from a first, nonconducting condition to a second, conducting condition by application of force to said cover layer, the resiliency of said cover layer returning said cover layer to the first condition thereof upon removal of the force and the base member being sufficiently rigid so as to maintain the configuration of said indentation during deformation of said cover layer.

8. The device of claim 7, wherein said cover layer is a tubular sleeve encompassing said base member.

* * * * *